US005239458A

United States Patent [19]

Suzuki

[11] Patent Number: 5,239,458

[45] Date of Patent: Aug. 24, 1993

[54] FADER DEVICE HAVING A FINE ADJUSTMENT OF THE SIGNAL LEVEL

[75] Inventor: Takashi Suzuki, Hamamatsu, Japan

[73] Assignee: Yamaha Corporation, Hamamatsu, Japan

[21] Appl. No.: 556,039

[22] Filed: Jul. 20, 1990

[30] Foreign Application Priority Data

Jul. 26, 1989 [JP] Japan ..... 1-193410

[51] Int. Cl.[5] ..... H04R 29/00

[52] U.S. Cl. ..... 364/188; 364/182; 381/107; 381/119

[58] Field of Search ..... 381/107, 109, 113, 104, 381/106, 119; 364/580, 550, 146, 142, 148, 167.01, 182, 188, 192, 581, 705.04

[56] References Cited

U.S. PATENT DOCUMENTS 4,511,824 4/1985 Goddard ..... 315/297
4,631,525 12/1986 Serravalle, Jr. ..... 381/109 X
5,054,077 10/1991 Suzuki ..... 381/109

*Primary Examiner*—Jack B. Harvey
*Assistant Examiner*—E. J. Pipala
*Attorney, Agent, or Firm*—Spensley Horn Jubas & Lubitz

[57] ABSTRACT

A fader device used for an audio mixer etc. includes fader operators, a signal processing circuit for processing signals in accordance with operation position of the fader operators, switches for switching an operation mode of fader operators between an absolute mode in which amounts of displacement of the fader operators represent absolute change value and a relative mode in which amounts of displacement of the fader operators are caused to represent relative change values by setting a predetermined displacement range of a control parameter. When the operation mode has been switched from the absolute mode to the relative mode, a control circuit peforms control in such a manner that the amounts of displacement of the fader operators in the absolute mode have been stored and the fader operators are forced to be set in central positions of the strokes of the fader operators. Total amount of operation is recognized by calculating the stored value corresponding to the central position and displacement value from the central position. The amounts of displacement of the fader operators in the relative mode can be controlled at a smaller ratio than in the absolute mode and a fine adjustment of a signal level thereby can be achieved.

4 Claims, 2 Drawing Sheets

FADER DEVICE HAVING A FINE ADJUSTMENT OF THE SIGNAL LEVEL

BACKGROUND OF THE INVENTION

This invention relates to a fader used in an audio mixer, a dimmer or the like and, more particularly, to a fader device capable of readily accomplishing a fine adjustment in a fader having fader operators of a short stroke.

A fader is a device for changing gain continuously and is used for, e.g., an audio device such as an audio mixer for individual adjustment of signal levels of multiple channels in mixing these signals. Conventional fader devices are constructed so that amounts of fading are fixedly determined depending upon operation positions of fader operators.

In the conventional fader devices, particularly in those in which the full stroke of each fader operator is relatively short, a fine adjustment of a signal level is rather difficult because such fine adjustment must be made within the short stroke, e.g., a few millimeters, in most cases.

It is, therefore, an object of the invention to provide a fader device capable of readily accomplishing a fine adjustment of a signal level in a fader having fader operators of a short full stroke.

SUMMARY OF THE INVENTION

A fader device achieving the above described object of the invention comprises fader operators capable of being operated both manually and by a motor, signal processing means for processing signals in accordance with fader operation positions of the respective fader operators, switching means for switching an operation state of the respective fader operators between a first operation state in which amounts of displacement of operation positions of the respective fader operators represent absolute change values and a second operation state in which amounts of displacement of operation positions of the respective fader operators are caused to represent relative change values by setting a predetermined weighting ratio of a control parameter to the amounts of displacement of the operation positions, and control means for performing a fader control in such a manner that, in the first operation state, values representing amounts of displacement of the operation positions of the respective fader operators are stored while processing of signals is performed in accordance with the amounts of displacement of the operation positions of the respective fader operators and, after operation of the switching means to switch the operation state of the fader operators from the first operation state to the second operation state, the values stored in the first operation state are increased or decreased in accordance with operation positions of the respective fader operators in the second operation state and processing of signals is performed in accordance with the increased or decreased value.

According to the invention, the values representing the amounts of displacement of operation positions of the fader operators in the first operation state have been stored when the operation state has been switched from the first operation state to the second operation state and the amounts of displacement of operation positions of the fader operators in the second operation state are treated as relative change amounts so that these amounts in the second operation state can be increased or decreased at a smaller ratio than in the first operation state and a fine adjustment of a signal level thereby can be achieved even in a fader having fader operators a short full stroke.

In one aspect of the invention, the control means displaces the operation positions of the respective fader operators to respective center positions by driving of the motor when the operation state of the fader operators has been switched from the first operation state to the second operation state. Since processing of the amounts of relative change is made starting from the center positions of the stroke of the fader operators, the state of fine adjustment can be readily recognized.

In another aspect of the invention, the control means displaces the respective fader operators to positions corresponding to the increased or decreased values in the second operation state by driving of the motor when the operation state has been switched from the second operation state to the first operation state. By this arrangement, the state of each signal level after the fine adjustment can be readily recognized.

In another aspect of the invention, the fader device further comprises means for selecting the weighting ratio of the control parameter to the amounts of displacement of the fader operators in the second operation state. Since the weighting ratio can be set freely by a player, a desired fine adjustment can be realized.

In still another aspect of the invention, in the second operation state, the control means displaces the fader operators to the center positions repeatedly by repeating the operation for switching the operation state to the second operation state and thereby renew the stored values with respect to the center positions. By repeating the relative change operation of the fader operators, an even finer adjustment of a signal level can be realized.

A preferred embodiment of the invention will be described below with reference to the accompanying drawings.

BRIEF DESCRIPTION OF THE DRAWINGS

In the accompanying drawings.

DESCRIPTION OF A PREFERRED EMBODIMENT

Figure 1:
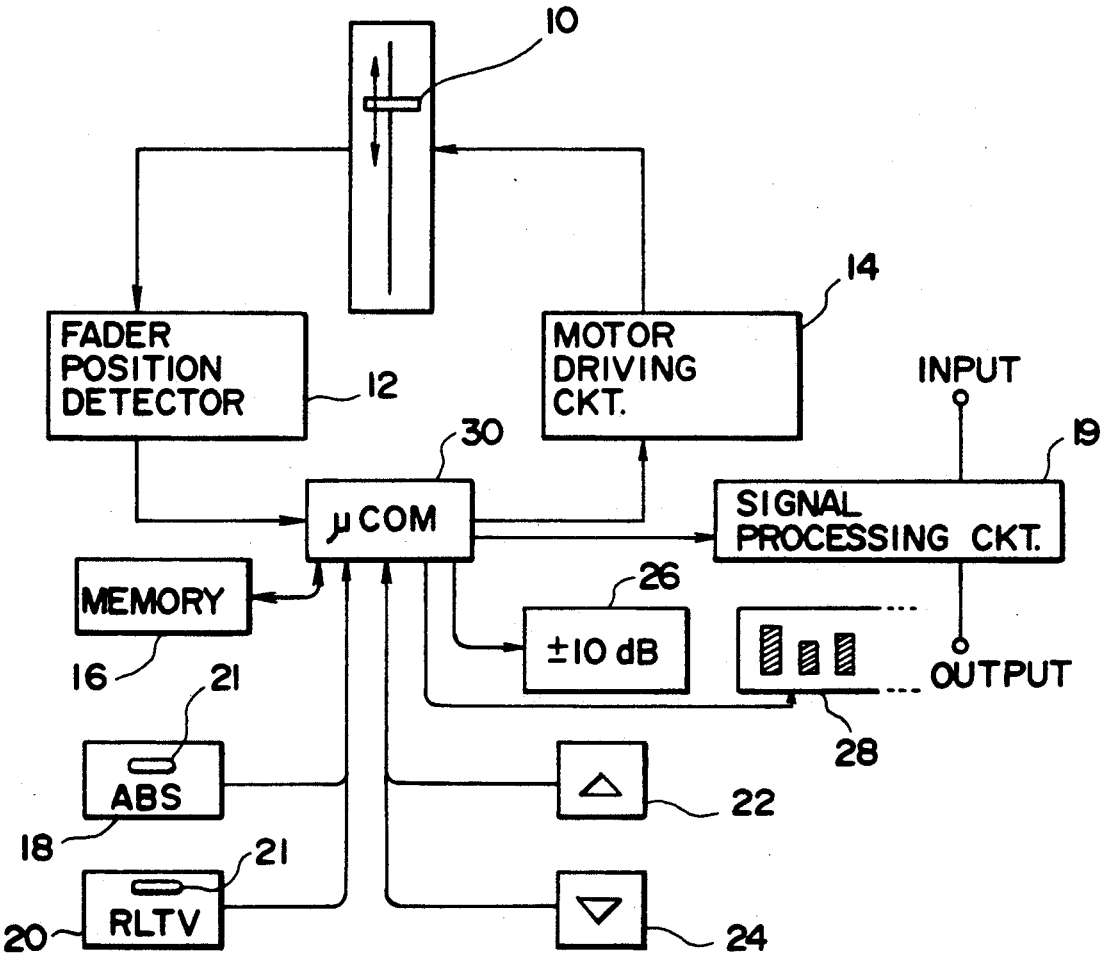
FIG. 1 is a block diagram showing a preferred embodiment of the fader device according to the invention.

FIG. 1 shows and embodiment of the invention. A fader operator 10 is provided for each of multiple input channels and can be moved in a sliding movement forwardly or backwardly either manually or automatically by driving of a motor. A motor driving circuit 14 drives the fader operator 10 by a motor (not shown). A fader position detector 12 detects an operation position of the fader operator 10. A memory 16 stores an amount of operation of the fader operator 10.

A signal processing circuit 19 variably controls the amount of fading, i.e., amount of signal processing (e.g., gain) in accordance with the operation position of the fader operator 10.

Switches 18 and 20 are provided for switching operations by the fader operator 10. Turning on of the switch 18 brings about an absolute mode ABS (which constitutes the first operation state). In the absolute mode, the fader operator 10 functions as an operator for adjusting an absolute amount of the fader operator 10 (hereinafter referred to as "absolute amount of fading") and controls gain within a range of, e.g., +10 dB to $-\infty_H$ (minus infinity). Turning on of the switch 20 brings about a relative mode RLTV (which constitutes the second operation state). In the relative mode, the fader operator 10 functions as an operator for adjusting a relative and fine fade amount (hereinafter referred to as "change amount of fading") and performs a fine adjustment of gain with a variable scale ranging from, e.g., +10 dB to −10 dB or +5 dB to −5 dB from the amount of fading available at the time point when the switch 20 has been turned on. At this time, the fader operator 10 is compulsorily moved to the center position of its stroke by driving of the motor. A current operation mode is known by lighting of a lighting device 21 such as an LED.

Figure 2:
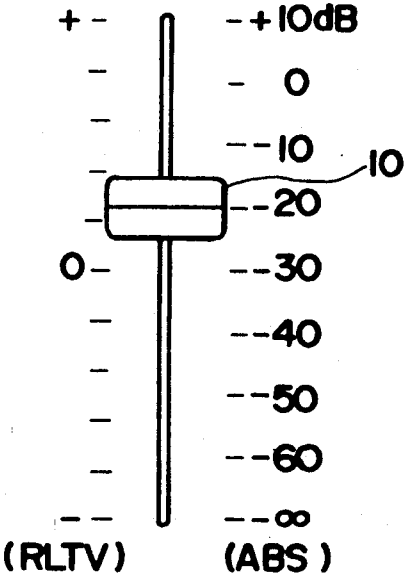
FIG. 2 is an example of a scale showing amount of operation of a fader operator.

FIG. 2 shows an example of scales provided on both sides of a groove along which the fader operator 10 moves. The right side scale is one showing the absolute mode ABS and the left side scale is one showing the relative mode RLTV.

In FIG. 1, push buttons 22 and 24 are provided for setting the scale of fader operation in the relative mode. When the push button 22 is pushed, the value increases (i.e., the range becomes wider) and when the push button 24 is pushed, the value decreases (i.e., the range becomes narrower). The determine scale is indicated by a display 26. Thus, by operating these push buttons 22 and 24, the ratio of weighting of the control parameter to the amount of displacement of the fader operator 10 in the relative mode can be set as desired by a player.

In the absolute mode, the weighting of the control parameter becomes the reference value itself.

A display 28 displays absolute amounts of fading of respective channels by a bar graph constituted of LCDs or the like device.

A microcomputer 30 performs various controls including a control of signal processing amount by the signal processing circuit 19 on the basis of a detected value by the fader position detector 12 and a value stored in the memory 16, switching between the absolute mode and the relative mode by operation of the switches 18 and 20, a control of the scale by the push buttons 22 and 24 during the relative mode, a display control of the displays 26 and 28, and a motor drive control by the motor drive circuit 14 during operation of the fader operator 10 by the motor.

The operation by the fader device shown in FIG. 1 will now be described.

Information of operation position of the fader operator 10 which has been detected by the fader position detector 12 is applied to the microcomputer 30. The microcomputer 30 sets the scale of the fader operation at a range of, e.g., +10 dB to $-\infty$ dB during the absolute mode, converts the input operation position information to a fade control signal of this scale and supplies it to the signal processing circuit 19 to control the gain. The absolute amount of fading at this time is stored in the memory 16 and displayed by a bar graph by the display 28.

By switching of the operation mode to the relative mode by turning on of the switch 20, the scale of the fader operation becomes smaller (i.e., the range becomes narrower). In other words, the ratio of weighting of the control parameter to the amount of displacement of the fader operator 10 becomes smaller. By the operation of the motor driving circuit 14, the fader operator 10 is compulsorily driven to the stroke center position of the fader operator 10. The value stored in the memory 16 however is held as it is and the fade amount actually obtained remains unchanged. By operating the fader operator 10 in this state, the amount of operation of the fader operator 10 is converted to the change amount of fading of the narrower scale based on the set weighting ratio. This change amount of fading is added to or subtracted from the absolute amount of fading stored in the memory 16 and the sum or difference value is supplied to the signal processing circuit 19 to control the fade amount. Since the fade amount has been converted to the narrow scale, a fine adjustment can be readily achieved even if the full stroke of the fader operator 10 is short. The contents of the memory 16 are rewritten to the increased or decreased absolute value of fading. The display 28 displays the absolute value of fading stored in the memory 16. The weighting ratio of the control parameter, i.e., the scale, can be changed by operating the push buttons 22 and 24. If the operation mode is changed from the absolute mode to the relative mode when fader operation position is in the vicinity of the maximum or minimum position, the fader operator 10 could be operated beyond the maximum or minimum position of the original fader scale. The microcomputer 30, however, performs a control so that a larger amount of signal processing will not be supplied in such a case. If the fader operator 10 is released at this time, the fader operator 10 is compulsorily moved back to the position corresponding to the maximum or minimum position in the fader scale.

If the switch 20 is pushed again in the relative mode, the relative change of the fader amount is further made from the current state. More specifically, the absolute value of fading at the time of turning on of the switch 20 is held as the value at the stroke center of the fader operator 10 and further scale down is effected. The fader operator 10 is driven to the stroke center again by the motor.

By bringing back the operation mode to the absolute mode by pushing the switch 18, the fader operator 10 is compulsorily driven to the fader operation position corresponding to the absolute amount of fading which has been increased or decreased by the fine adjustment and stored in the memory 16 whereby operation by the absolute mode is made possible.

Figure 3A:
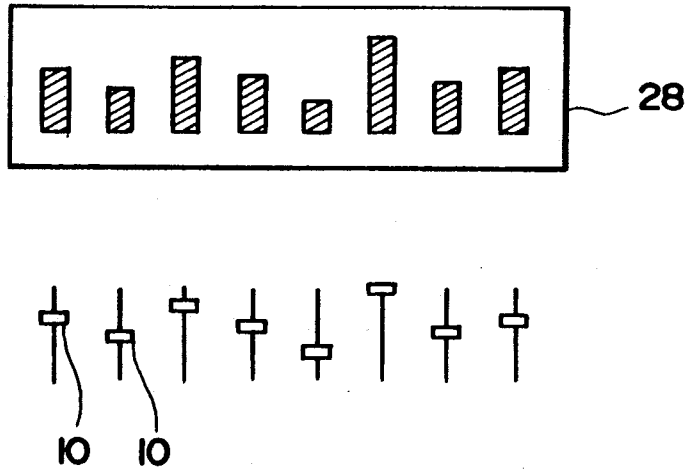
FIGS. 3A and 3B are diagrams showing examples of operation states of the fader operators and display states of display 28.
Figure 3B:
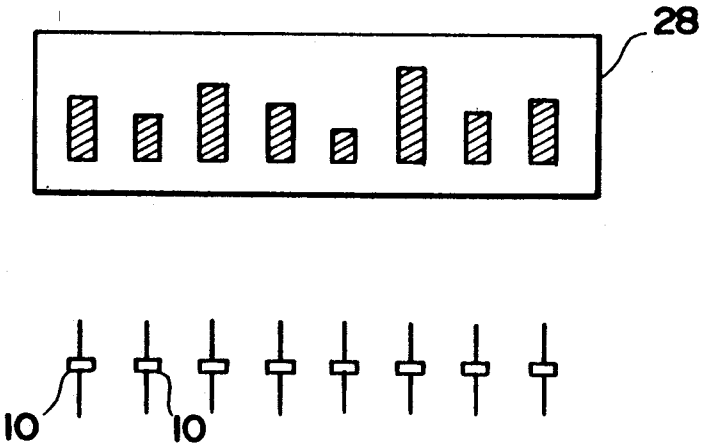

FIG. 3 shows operation states of the fader operators 10 and display states of the display 28. FIG. 3A shows those in the absolute mode in which the operation state of the fader operators 10 coincides with the display state of the display 28. FIG. 3B shows those when the operation mode has been switched to the relative mode. The fader operators 10 have all been compulsorily driven to the stroke center positions. The display 28 remains unchanged in its display of the absolute amount of fading. The fine adjustment can be made by operating the fader operator 10 in this state and the absolute amount of fading as a result of the fine adjustment is displayed in the display 28. In this manner, the absolute amount of fading is displayed by the display 28 during the relative mode and the amount of fine adjustment of the fader operation is indicated as the operation position of the fader operator 10 and, accordingly, a fine adjustment can be made while watching the absolute amount of fading whereby the adjustment can be facilitated.

What is claimed is:

1. A fader device comprising:

a plurality of fader operators displaceable between a plurality of operation positions;

signal processing means for processing signals in accordance with respective operation positions of the plurality of fader operators;

mode switching means for switching an operation mode of the plurality of fader operators between a first operation mode, in which the displacement of the plurality of fader operators represent absolute change values, and a second operation mode, in which the displacement of the plurality of fader operators represent relative change values variable in accordance with a weighting factor;

control means for controlling the fader device such that, in the first operation mode, values representing the displacement of the operation positions of the plurality of fader operators are stored while the signal processing means processes signals in accordance with the displacement of the operation positions of the respective fader operators, and in the second operation mode, the values stored in the first operation mode are increased or decreased in accordance with the relative change values determined by the displacement of the plurality of fader operators in the second operation mode such that the processing of signals is performed in accordance with the increased or decreased values; and a motor for electrically displacing the plurality of fader operators, wherein said control means displaces the operation positions of the plurality of fader operators to respective center positions by driving the motor when the operation mode of the fader operators has been switched from the first operation mode to the second operation mode.

2. A fader device as defined in claim 1, wherein the operation for switching the operation mode to the second operation mode is repeated such that the control means displaces the plurality of fader operators to the center positions and the stored values are reset with respect to the center positions.

3. A fader device comprising:

a plurality of fader operations displaceable between a plurality of operation positions;

signal processing means for processing signals in accordance with respective operation positions of the plurality of fader operators;

mode switching means for switching an operation mode of the plurality of fader operators between a first operation mode, in which the displacement of the plurality of fader operators represent absolute change values, and a second operation mode, in which the displacement of the plurality of fader operators represent relative change values variable in accordance with a weighting factor;

control means for controlling the fader device such that, in the first operation mode, values representing the displacement of the operation positions of the plurality of fader operators are stored while the signal processing means processes signals in accordance with the displacement of the operation positions of the respective fader operators, and in the second operation mode, the values stored in the first operation mode are increased or decreased in accordance with the relative change values determined by the displacement of the plurality of fader operators in the second operation mode such that the processing of signals is performed in accordance with the increased or decreased values; and a motor for electrically displacing the plurality of fader operators, wherein said control means displaces the plurality of fader operators to positions corresponding to the increased or decreased values in the second operation mode by driving the motor when the operation mode has been switched from the second operation mode to the first operation mode.

4. A fader device comprising:

a plurality of fader operators displaceable between a plurality of operation positions;

signal processing means for processing signals in accordance with respective operation positions of the plurality of fader operators;

mode switching means for switching an operation mode of the plurality of fader operators between a first operation mode, in which the displacement of the plurality of fader operators represent absolute change values, and a second operation mode, in which the displacement of the plurality of fader operators represent relative change values variable in accordance with a weighting factor;

control means for controlling the fader device such that, in the first operation mode, values representing the displacement of the operation positions of the plurality of fader operators are stored while the signal processing means processes signals in accordance with the displacement of the operation positions of the respective fader operators, and in the second operation mode, the values stored in the first operation mode are increased or decreased in accordance with the relative change values determined by the displacement of the plurality of fader operators in the second operation mode such that the processing of signals is performed in accordance with the increased or decreased values; and means for selecting the weighting factor.

* * * * *